US006457525B1

(12) United States Patent
Scott

(10) Patent No.: US 6,457,525 B1
(45) Date of Patent: Oct. 1, 2002

(54) METHOD AND APPARATUS FOR COMPLETING MULTIPLE PRODUCTION ZONES FROM A SINGLE WELLBORE

(75) Inventor: Bruce David Scott, McKinney, TX (US)

(73) Assignee: ExxonMobil Oil Corporation, Irving, TX (US)

( * ) Notice: Subject to any disclaimer, the term of this patent is extended or adjusted under 35 U.S.C. 154(b) by 0 days.

(21) Appl. No.: 09/738,195

(22) Filed: Dec. 15, 2000

(51) Int. Cl.[7] ..... E21B 23/03; E21B 43/14

(52) U.S. Cl. ..... 166/300; 166/50; 166/117.6; 166/313; 166/317; 166/376; 175/81

(58) Field of Search ..... 166/50, 117.5, 166/117.6, 300, 313, 317, 376, 387; 175/79, 80, 81

(56) References Cited

U.S. PATENT DOCUMENTS 4,402,551 A * 9/1983 Wood et al. ..... 166/117.5
5,353,876 A * 10/1994 Curington et al. ..... 166/313
5,845,710 A * 12/1998 Longbottom et al. .... 166/117.6
6,015,012 A * 1/2000 Reddick ..... 166/117.5
6,145,593 A * 11/2000 Hennig ..... 166/177.6
6,241,021 B1 * 6/2001 Bowling ..... 166/380

* cited by examiner

*Primary Examiner*—George Suchfield

(57) ABSTRACT

Method and apparatus for producing multiple zones from a single wellbore wherein a hollow whipstock is used to complete a lateral into an upper zone which lies above a lower producing zone. The whipstock has openings through its tapered face which, in turn, are sealed by dissolvable plugs (e.g. aluminum). Once the lateral has been completed, a reagent (e.g. hydrochloric acid) is pumped down the wellbore to dissolve the plugs and open the openings through the face of the whipstock thereby allowing the flow from the lower zone to pass through the whipstock to be produced up through the wellbore along with the flow from the upper production zone.

9 Claims, 2 Drawing Sheets

METHOD AND APPARATUS FOR COMPLETING MULTIPLE PRODUCTION ZONES FROM A SINGLE WELLBORE

FIELD OF THE INVENTION

The present invention relates to completing multiple production zones from a single wellbore and in one aspect relates to a whipstock which is used to drill a lateral well into an upper productive zone from a wellbore wherein the whipstock has openings therethrough which, in turn, can be opened after the lateral has been completed to allow flow from lower zones through the whipstock.

BACKGROUND OF THE INVENTION

Hydrocarbons (i.e. oil and gas) have been routinely produced by drilling and casing a single, main wellbore (e.g. a substantially vertical wellbore) downward from the surface into a lower, primary production subterranean formation or a zone within the formation. In doing so, the wellbore often passes through other lesser-productive formation(s) or zones (s) which lie above the primary production formation. By casing the wellbore substantially throughout its depth, production from these upper formations is initially blocked by the well casing. Due to the low productivity expected from these upper formation(s), it is usually impractical from a commercial standpoint to merely perforate the casing adjacent these formations and commingle this production with that from the lower primary productive formation.

Recently, due to conservation and other considerations, it is becoming more desirable to recover hydrocarbons from these lesser-productive formation(s) or zone(s), especially as the production from the primary formation begins to decline. One known technique for doing this involves drilling one or more "laterals" or "drain-holes" substantially horizontally outward into the formation from the main wellbore. As understood in the art, these laterals significantly increase the drainage area around the main wellbore and provide an unrestricted flowpath for fluids from the outer regions of the formation directly into the main wellbore.

Typically, a lateral is drilled by first setting a "whipstock" or diverter in the well casing at a point adjacent the upper production formation. A work string having a mill on the lower end thereof is lowered and deflected off the whipstock to mill a window in the well casing adjacent the formation. The mill is then replaced with a drill bit and the lateral is drilled out into the formation through the window in the casing.

In the prior art, the whipstock is typically landed onto a packer which, in turn, blocks flow through the wellbore at that point. That is, production from the primary, lower formation can no longer flow through the wellbore to the surface once the whipstock assembly is in place. This may seriously affect the economics of the well since the lower, primary formation may still contain a significant amount of recoverable hydrocarbons. Accordingly, it is desirable to maintain fluid communication with the primary formation after a lateral has been completed into an upper formation so that both formations can be produced to the surface.

One way to accomplish this is to use a whipstock which is retrievable through the well casing once the lateral has been completed. However, this can be extremely difficult, if possible at all, to actually carry out commercially in the most wells. Further, it has been proposed that the face of the whipstock be "perforated" with a special perforating gun after the lateral has been completed. This is to provide openings through the whipstock which, in turn, allows the production from the lower formation to flow through the whipstock and on to the surface. However, since the target area or face of a typical whipstock is long but quite narrow, the proper positioning of the perforating gun in relation to the face of the whipstock would be extremely difficult, if possible at all, in most field applications. Accordingly, it is highly likely that the orientation of the gun would be such that no perforations would be formed in the face of the whipstock and therefore no flow through the whipstock would be established.

SUMMARY OF THE INVENTION

The present invention provides a method and apparatus for producing multiple formations or zones from a single wellbore wherein the wellbore passes through an upper production formation or zone and a lower production formation or zone. A whipstock, having openings therethrough which, in turn, are sealed by dissolvable plugs, is positioned within the wellbore at a point adjacent or above the upper production zone. A lateral wellbore is drilled and completed into the upper zone by using the whipstock. The production from the lower zone is blocked by the whipstock while the lateral wellbore is being completed. As used herein throughout both the specification and claims, when the term "formation" is used, it is intended to cover not only distinct subterranean formations but also productive zones within the same formation.

Once the lateral has been completed, the openings in the whipstock are opened by pumping a reagent down the wellbore to dissolve the dissolvable plugs. Once the plugs are dissolved and the openings are open, flow from the lower production zone can now flow through the openings and be produced up through the wellbore along with the flow from the upper production zone.

More specifically, the whipstock of the present invention is "hollow" in that it is formed with a large cavity within the body thereof. A tubular extension extends from the lower end of the body and provides a fluid inlet for flow from below the whipstock into the cavity. The tubular extension is adapted to be received in a packer/anchor, set within the wellbore, to thereby land and latch the whipstock in its operable position within the main wellbore. When the whipstock is in position, flow from below the whipstock cannot flow past the whipstock.

One or more openings are provided through the tapered face of the whipstock and open into a cavity within the body of the whipstock which, in turn, is comprised of a hardened material, e.g. steel. Each opening is initially closed by a plug of a dissolvable material; preferably a metal (e.g. aluminum, magnesium, etc.) which can be dissolved by an appropriate reagent (e.g. hydrochloric acid). Once a lateral has been completed into an upper formation, a slug of a reagent (e.g. hydrochloric acid) is pumped down the wellbore and into contact with the plugs within the openings in the face of the whipstock. The reagent is allowed to react with the plugs to thereby dissolve the plugs thereby opening the openings to flow. This allows the flow from the lower production formation or zone to flow through the extension, cavity, through the now-open openings in the whipstock, and be produced through the wellbore along with the flow from the upper zone.

BRIEF DESCRIPTION OF THE DRAWINGS

The actual construction, operation, and apparent advantages of the present invention will be better understood by referring to the drawings which are not necessarily to scale and in which like numerals identify like parts and in which.

While the invention will be described in connection with its preferred embodiments, it will be understood that this invention is not limited thereto. On the contrary, the invention is intended to cover all alternatives, modifications, and equivalents which may be included within the spirit and scope of the invention, as defined by the appended claims.

DETAILED DESCRIPTION OF THE INVENTION

Figure 1:
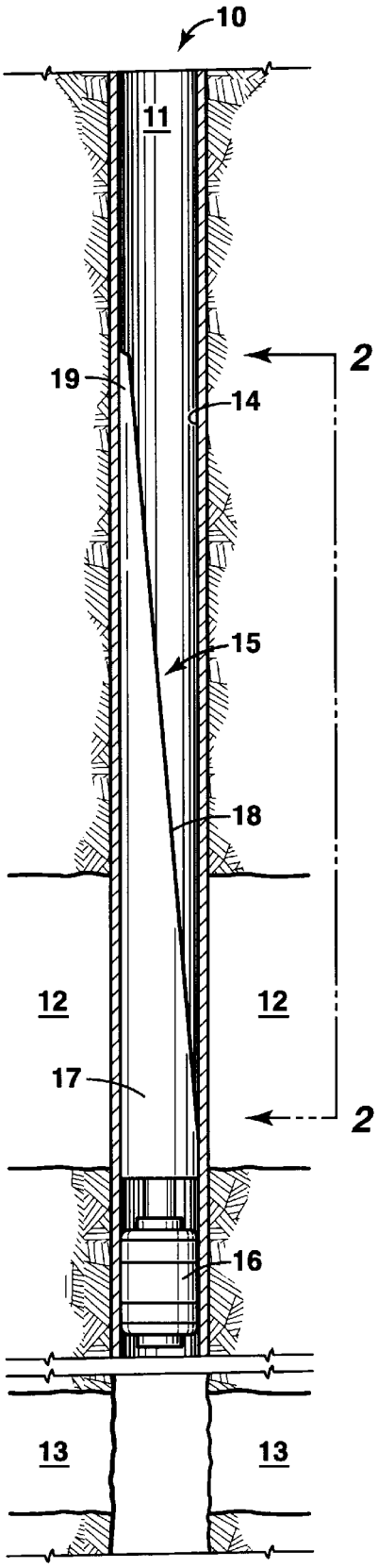
FIG. 1 is a sectional view of a portion of a cased wellbore having the whipstock of the present invention in position adjacent an upper production zone.

Referring more particularly to the drawings, FIG. 1 illustrates a portion of a well 10 having a wellbore 11 which has been drilled through an upper production formation or zone 12 and a primary, lower production formation of zone 13. Wellbore 11 is shown as being cased with casing 14 to a point near the upper end of lower zone 13 which, in turn, is "open hole" completed. However, as will be fully understood in the art, lower zone 13 may also be cased by extending casing 14 through lower zone 13 and then perforating the casing to establish fluid communication between zone 13 and wellbore 11 without departing from the present invention. Also, as will be understood, although not shown, casing 14 is normally cemented in place within the wellbore. Further, while the present invention will be described in relation to a substantially vertical wellbore 11, it should be understood that the present invention is equally applicable for use in horizontal or inclined wellbores and accordingly, the terms "top and bottom" and "upper and lower", as used herein, are relative in nature when referring to respective positions within a main wellbore.

In a typical well 10 such as that shown in FIG. 1, the upper portion of wellbore 11 is cased and hydrocarbons (e.g. oil and gas) are produced from lower primary zone 13 through a tubing string (not shown) in wellbore 11 while any production from upper zone 12 is blocked by casing 14. When production from lower zone 13 drops to an undesirable level or for any other reason it becomes desirable to increase production from well 10, the whipstock 15 of the present invention is run into wellbore 11 on a workstring (not shown) and is positioned within casing 14 at a point adjacent or above the upper zone 12. Whipstock 15 can be supported within casing 14 by any well known means (e.g. packer/anchor 16) which, in turn, has been previously set at the desired depth within casing 14 by standard techniques.

Figure 2:
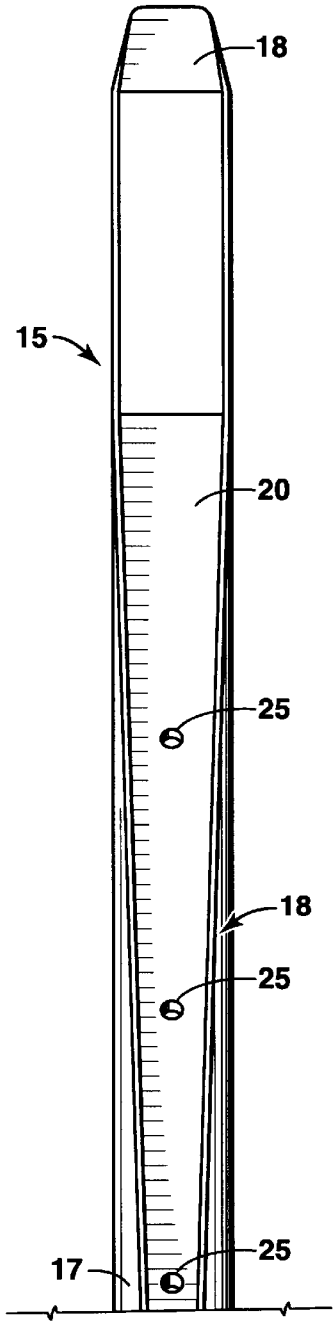
FIGS. 2 is a partial front view of the whipstock taken between lines 2—2 of FIG. 1.
Figure 3:
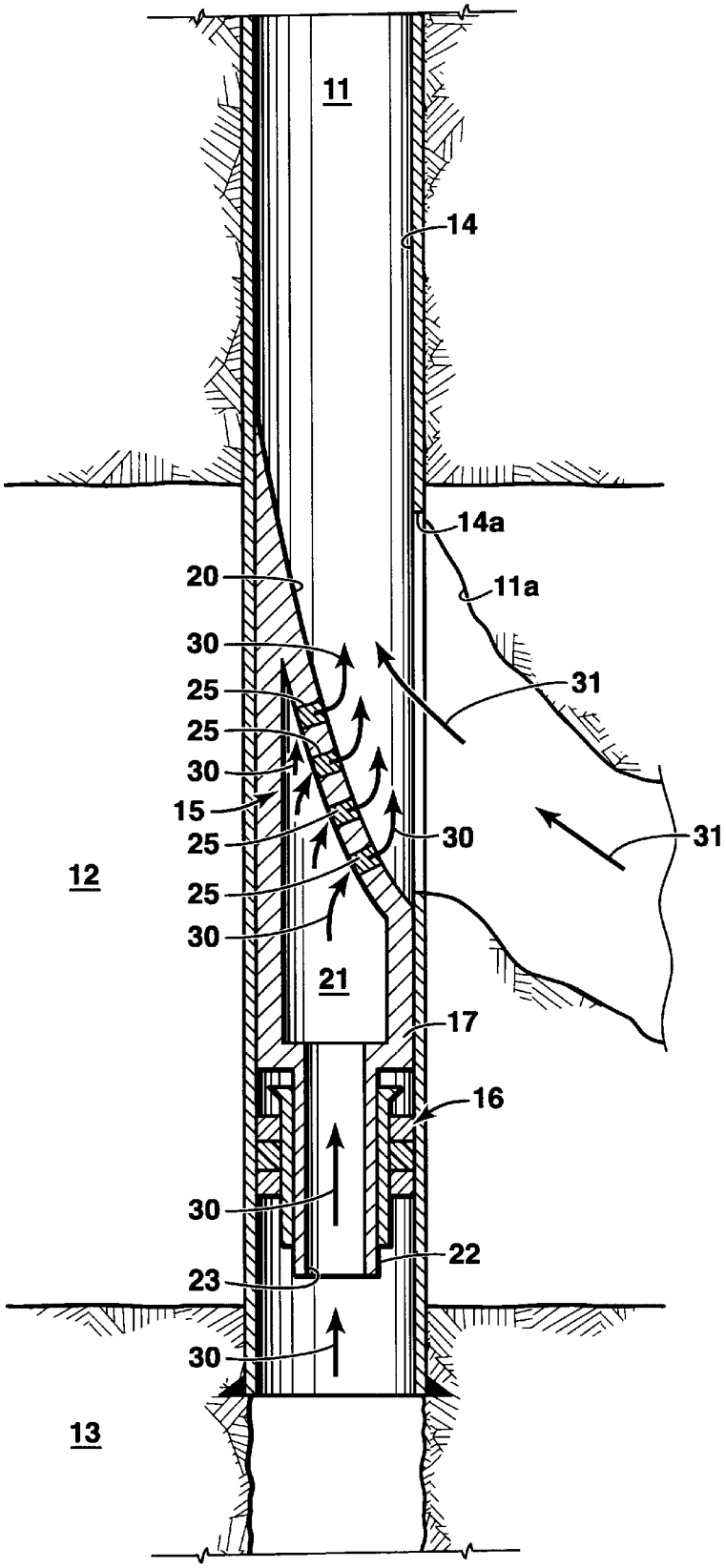
FIG. 3 is a detailed sectional view of the whipstock of the present invention.

The basic configuration of whipstock 15 is similar to that of many prior art, conventional whipstocks in that it is formed from a hardened material, e.g. steel, and is comprised of an elongated body 17 which is substantially cylindrical at its lower portion and is inclined or tapered along a portion (i.e. tapered portion 18) of its length towards its upper end 19. The surface or face of the tapered portion may be somewhat concaved (e.g. concaved face 20, FIG. 2) as is typical with whipstocks of this type. However, in accordance with the present invention, present whipstock 15 differs from this basic configuration in many significant aspects as will now be set forth and as best seen in FIG. 3.

The cylindrical body 17 of present whipstock 15 is "hollow" in that it is formed with a large cavity 21 or the like therein. Tubular extension 22 extends from the lower end of body 17 and provides a fluid inlet for flow from below whipstock 15 into the cavity 21. As shown in FIG. 3, packer/anchor 16 has a passage 23 therethrough which receives extension 22 of whipstock 15 to thereby land and latch whipstock 15 in its operable position within wellbore 11. When the whipstock 15 is in position, flow from below the whipstock can flow through extension 22 and into cavity 21.

Figure 4:
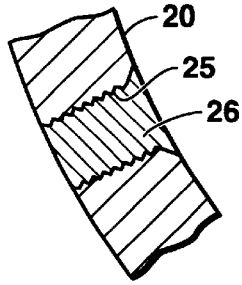
FIG. 4 is a partial, enlarged sectional view of an opening through the face of the whipstock of FIG. 3 having a dissolvable plug therein.

One or more openings 25 (four shown in FIG. 3) are provided through the face 20 which open into cavity 21. Each opening 25 is initially closed or blocked by a plug 26 of a dissolvable material (as shown in FIG. 4) . The plugs are secured in their respective openings by any appropriate means; e.g. threads (FIG. 4); adhesive; forced fitted; heat shrink; etc. Plugs 26 may be of any material which will maintain its integrity in the presence of well fluids while dissolving in an appropriate reagent. Preferably the plugs are comprised of a metal (e.g. aluminum, magnesium, etc.) which can be dissolved by an appropriate reagent (e.g. hydrochloric acid).

In operation, packer/anchor 16 is set at a point adjacent or above upper zone 12 and whipstock 15 is lowered and landed onto packer/anchor 16 by known techniques in the art. Once whipstock 15 is in its operable position, a mill (not shown) is lowered on a workstring (e.g. drill string, not shown) and a window 14*a* (FIG. 3) is milled in casing 14 at a point substantially adjacent upper zone 12, again using known techniques in the art. The mill may then be replaced with a drill bit or the like and a lateral wellbore 11*a* is drilled and completed into upper zone 12 through the window 14*a* as will be fully understood in the art. During the drilling and completion of lateral 11*a,* flow from the lower, primary production zone 13 is blocked by packer/anchor 16 and the plugs 26 in the openings 25 through whipstock 15.

Once the lateral 11*a* has been completed, a slug of a reagent (e.g. hydrochloric acid) is pumped down wellbore 11 and into contact with the face 20 of whipstock 15. The pumping is stopped and the reagent is allow to react with the plugs 26 (e.g. aluminum, magnesium, etc.) to dissolve the plugs, thereby opening the openings to flow. This allows the flow from the lower production zone 13 (arrows 30 in FIG. 3) to flow through extension 22, cavity 21, through openings 25 in the whipstock, and commingle with the flow from the upper zone 12 (arrows 31 in FIG. 3) for production to the surface.

While only one upper zone 13 has been shown and discussed, it should be realized that the present invention can also be utilized in completing and producing additional formations or zones which lie above upper zone 13. That is, a second whipstock can be set at a second upper zone and the above-described procedure can then be repeated to produce the second upper zone and so on until all of the upper zones have been completed for production. Further, while the flows from the lower and upper production zones are shown as being commingled for production to the surface, it should be recognized that a separate string of production tubing (not shown) could be used to produce flow from one of the zones while the flow from the other zone is produced through the well annulus.

What is claimed is:

1. A method for producing hydrocarbons from multiple zones wherein a main wellbore has been drilled through an upper production zone and into a lower production zone, said method comprising:

positioning a whipstock within said main wellbore at a point adjacent said upper production zone, wherein said whipstock has a face in which at least one opening passes therethrough, said at least one opening being initially blocked by a plug of dissolvable material;

using said whipstock to drill and complete a lateral wellbore from said main wellbore into said upper production zone;

establishing fluid communication through said whipstock by dissolving said plug of dissolvable material after said lateral wellbore has been completed into said upper production zone; and producing flow from said lower production zone up through said main wellbore and through said whipstock with flow from said upper production zone.

2. The method of claim 1 wherein said plug is dissolved by pumping a reagent down said main wellbore and into contact with said plug whereupon said reagent dissolves said dissolvable material.

3. The method of claim 2 wherein said dissolvable material is a metal and said reagent is an acid which dissolves said dissolvable material.

4. The method of claim 3 wherein said metal is selected from the group of aluminum and magnesium and said acid is comprised of hydrochloric acid.

5. A whipstock comprising:

a hollow cylindrical body having a cavity therein and a tapered face thereon; said cavity having a fluid inlet at the lower end thereof to allow flow into said cavity from below said whipstock when said whipstock is in an operable position within a wellbore;

at least one opening through said face and into said cavity within said body of said whipstock; and a plug of dissolvable material within said at least one opening to block flow through said opening during use of said whipstock within a wellbore.

6. The whipstock of claim 5 wherein said plug of dissolvable material is a metal.

7. The whipstock of claim 5 wherein said metal is selected from the group of aluminum and magnesium.

8. The whipstock of claim 7 wherein said at least one opening comprises:

a plurality of openings through said face of said whipstock.

9. The whipstock of claim 8 wherein said inlet into said cavity comprises:

a tubular extension extending from the lower end of said body of said whipstock, said tubular extension adapted to be received in a packer for landing said whipstock in a wellbore.

* * * * *